US009152075B2

(12) United States Patent
Jung et al.

(10) Patent No.: US 9,152,075 B2
(45) Date of Patent: Oct. 6, 2015

(54) IMAGE FORMING APPARATUS

(71) Applicant: SAMSUNG ELECTRONICS CO., LTD., Suwon-si, Gyeonggi-do (KR)

(72) Inventors: Seung Bok Jung, Hwaseong-si (KR); Young Chae Kim, Seoul (KR); Jin Hong Kim, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 124 days.

(21) Appl. No.: 13/714,902

(22) Filed: Dec. 14, 2012

(65) Prior Publication Data

US 2013/0156463 A1 Jun. 20, 2013

(30) Foreign Application Priority Data

Dec. 15, 2011 (KR) ..... 10-2011-0135427

(51) Int. Cl.

| | |
|---|---|
| ***G03G 15/00*** | (2006.01) |
| ***G03G 21/18*** | (2006.01) |
| ***G03G 15/06*** | (2006.01) |
| ***G03G 21/16*** | (2006.01) |

(52) U.S. Cl.

CPC ..... *G03G 15/06* (2013.01); *G03G 21/1633* (2013.01); *G03G 21/1842* (2013.01); *G03G 21/1853* (2013.01); *G03G 2221/1684* (2013.01); *G03G 2221/1687* (2013.01); *G03G 2221/1869* (2013.01)

(58) Field of Classification Search

CPC ..... G03G 15/06; G03G 221/1678; G03G 221/1684; G03G 221/1687

USPC ..... 399/107, 110, 113, 114, 111

See application file for complete search history.

(56) References Cited

U.S. PATENT DOCUMENTS

| | | | | |
|---|---|---|---|---|
| 2008/0159772 | A1* | 7/2008 | Koishi et al. | 399/90 |
| 2008/0159774 | A1* | 7/2008 | Tanabe et al. | 399/90 |
| 2009/0129812 | A1* | 5/2009 | Kawanami et al. | 399/111 |
| 2009/0190953 | A1 | 7/2009 | Okabe | |

FOREIGN PATENT DOCUMENTS

| | | |
|---|---|---|
| JP | 4372214 | 9/2009 |
| KR | 10-2009-0080129 | 7/2009 |
| WO | 2010/035535 A1 | 4/2010 |

OTHER PUBLICATIONS

Partial European Search Report mailed Aug. 26, 2013 in related European Application No. 12197327.5.

(Continued)

*Primary Examiner* — David Gray
*Assistant Examiner* — Michael Harrison
(74) *Attorney, Agent, or Firm* — Staas & Halsey LLP

(57) ABSTRACT

An image forming apparatus is provided. The apparatus includes a body provided with an opening at one side thereof, a developing tray movably installed at the opening, a plurality of developing units mounted to the developing tray, and a pair of frames forming opposite inner sides of the body. The frames are provided with a plurality of seating grooves to support lower ends of the developing units such that the developing units are supported by the frames, and therefore the positions of the photosensitive bodies of the developing units with respect to other constituents supported by the frames may be accurately regulated.

26 Claims, 10 Drawing Sheets

(56) References Cited

OTHER PUBLICATIONS

Extended European Search Report mailed Nov. 18, 2013 in related European Application No. 12197327.5.

Korean Office Action mailed Oct. 1, 2014 in related Korean Application No. 10-2011-0135427.

* cited by examiner

IMAGE FORMING APPARATUS

CROSS-REFERENCE TO RELATED APPLICATIONS

This application is related to, and claims priority to Korean Patent Application No. 10-2011-0135427, filed on Dec. 15, 2011 in the Korean Intellectual Property Office, the disclosure of which is incorporated herein by reference.

BACKGROUND

1. Field

Embodiments of the present invention relate to an image forming apparatus equipped with a development tray movably installed on a body and provided with a development unit.

2. Description of the Related Art

Generally, an image forming apparatus forms an image on a printing medium. Examples of such an image forming apparatus include a printer, a copier, a facsimile machine, and a complex machine having functions of the one or more apparatuses.

An image forming apparatus includes a body provided, at one side thereof, with an opening, a plurality of developing units disposed in the body, each of the developing units capable of developing an electrostatic latent image into a visible image using a corresponding one of developing agents of different colors, an exposure device to scan light onto photosensitive bodies of the development units and thus to form an electrostatic latent image on the photosensitive body of each development unit, a transfer device to transfer the visible image developed using the corresponding developing agent to a printing medium, and a fusing device to fuse the developing agents of the visible image to the printing medium.

A type of image forming apparatus has a plurality of developing units installed in a developing tray movably installed in an opening formed at one side of a body, to easily and conveniently replace developing units whose developing agents have been consumed.

SUMMARY

It is an aspect of the present invention to provide an image forming apparatus that allows developing units to be more accurately installed through a developing tray in a body of the apparatus.

Additional aspects of the invention will be set forth in part in the description which follows and, in part, will be obvious from the description, or may be learned by practice of the invention.

In accordance with an aspect of the present invention, an image forming apparatus includes a body provided with an opening at a side thereof, a developing tray movably installed at the opening, a plurality of developing units mounted to the developing tray, a plurality of, for example, a pair of frames forming opposite inner sides of the body, and a plurality of seating grooves provided in the frames to support lower ends of the plurality of developing units.

The image forming apparatus includes a plurality of seating members, each of which is provided with a plurality of seating grooves on an upper side thereof and disposed at a corresponding one of the plurality of the frames.

Each of the seating members may be integrated into the corresponding one of the frames.

Each of the seating grooves may be open upward and formed to have a V shape.

Each of the developing units includes a developing housing forming an outer appearance thereof, wherein the developing housing includes a plurality of, for example, a pair of protruding portions disposed at an upper portion of one side of the developing housing and spaced from each other, and a corresponding one of the frames includes a projection which is supported between the plurality of protruding portions.

The image forming apparatus includes a cover pivotably installed at the body to rotate about a lower end of the cover to open and close the opening, a plurality of, for example, a pair of movement guides allowing the developing tray to be installed thereon to be horizontally movable, and installed respectively at the pair of frames to be vertically movable, a plurality of engagement links to move the movement guides according to opening and closing of the cover, and a plurality of guide members installed at the movement guides to allow the movement guides to be movably installed at the frames, wherein each of the frames includes a plurality of guide slots in which the guide members are movably installed.

Each of the guide slots includes a first guide section to guide downward movement of a corresponding one of the movement guides, a second guide section formed at a higher position than the first section to guide upward movement of the corresponding one of the movement guides, and an inclined section formed to be inclined to connect the first guide section and the second guide section.

Each of the engagement links includes an engagement portion protruding toward a corresponding one of the movement guides, and an engagement projection arranged at the engagement portion, wherein the corresponding one of the movement guides includes an engagement slot extending vertically to allow the engagement projection to be installed therein to be vertically movable.

The image forming apparatus includes a pressing unit to press the developing units downward in connection with movement of the movement guides.

The pressing unit includes a pressing housing forming an outer appearance of the pressing unit and installed at one of the frames, a pressing frame installed in the pressing housing to be vertically movable, at least one pressing member installed at the pressing frame to be vertically movable, and at least one elastic member to elastically support the at least one pressing member downward.

The pressing unit further includes a plurality of raising and lowering links rotatably installed at the pressing housing such that the pressing frame is raised or lowered in connection with movement of the movement guides as the plurality of raising and lowering links rotates.

The plurality of raising and lowering links includes a first raising and lowering link to transfer force to an end of the pressing frame, and a second raising and lowering link and a third raising and lowering link to transfer the force to the other end of the pressing frame, wherein the first raising and lowering link includes a first cam portion supported by a corresponding one of the movement guides, and a first hinge portion pivotably installed at an end of the pressing frame, the second raising and lowering link includes a second cam supported by the corresponding one of the movement guides, and a first connecting portion connected with the third raising and lowering link, the third raising and lowering link includes a second connecting portion pivotably connected to the first connecting portion, and a second hinge pivotably installed at the other end of the pressing frame, and the corresponding one of the movement guides includes a first cam surface to interact with the first cam portion, and a second cam surface to interact with the second cam portion.

In accordance with an aspect of the present invention, an image forming apparatus includes a body provided with an opening at one side thereof, a developing tray movably installed at the opening, a plurality of developing units mounted to the developing tray, a plurality of, for example, a pair of frames forming opposite inner sides of the body, a cover pivotably installed at the body to rotate about a lower end of the cover to open and close the opening, and a pressing unit to press the developing units downward in connection with opening and closing of the cover.

In accordance with an aspect of the present invention, an image forming apparatus includes a body provided with an opening, a frame disposed in the body, a developing tray movably installed at the frame to enter and come out of the body through the opening, a plurality of developing units configured to contain developing agents and detachably mounted to the developing tray, each of the developing units including a developing housing having a side facing the frame, a plurality of projections protruding from one of the side of the developing housing and the frame to respectively correspond to the developing units, and a plurality of protruding portions provided at the other side of the developing housing and the frame to respectively correspond to the projections, each of the protruding portions restricting a corresponding one of the projections to limit movement of a corresponding one of the developing units.

The plurality of the protruding portions includes a plurality of, for example, a pair of protruding portions corresponding to one of the projections and disposed to be spaced from each other, wherein the corresponding one of the projections may be supported between the pair of the protruding portions.

The plurality of the developing units may be arranged in cascade, and the pair of the protruding portions may be disposed to support front and rear sides of the corresponding one of the projections.

The plurality of the projections may be disposed at the frame, and each of the plurality of the protruding portions may be disposed at the developing housing of a corresponding one of the developing units.

Each of the developing units further may include a photosensitive body rotatably supported by a lower end thereof, and each of the plurality of the protruding portions may be disposed to limit movement of an upper end of a corresponding one of the developing units.

The image forming apparatus includes a plurality of seating grooves provided at the frame to respectively support lower ends of the plurality of developing units.

In accordance with an aspect of the present invention, a developing unit mountable to a body of an image forming apparatus through a developing tray movably installed at a frame includes a developing housing having a side facing the frame when the developing unit is mounted to the image forming apparatus, and at least one protruding portion provided at the side of the developing housing such that when the developing unit is mounted to the image forming apparatus, the at least one protruding portion is coupled with a projection provided at the frame to limit movement of the developing unit.

The developing unit may include a photosensitive body rotatably installed at a lower end of the developing housing, wherein the at least one protruding portion may be disposed at an upper end of the developing housing.

The at least one protruding portion may include a plurality of, for example, a pair of protruding portions disposed to be spaced from each other to support opposite sides of the projection provided at the frame.

The at least one protruding portion may be arranged at an upper end of the side of the developing housing to limit movement of an upper end of the developing housing, and a lower end of the developing housing may be supported by a seating groove provided at the frame when the developing housing is mounted to the image forming apparatus.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
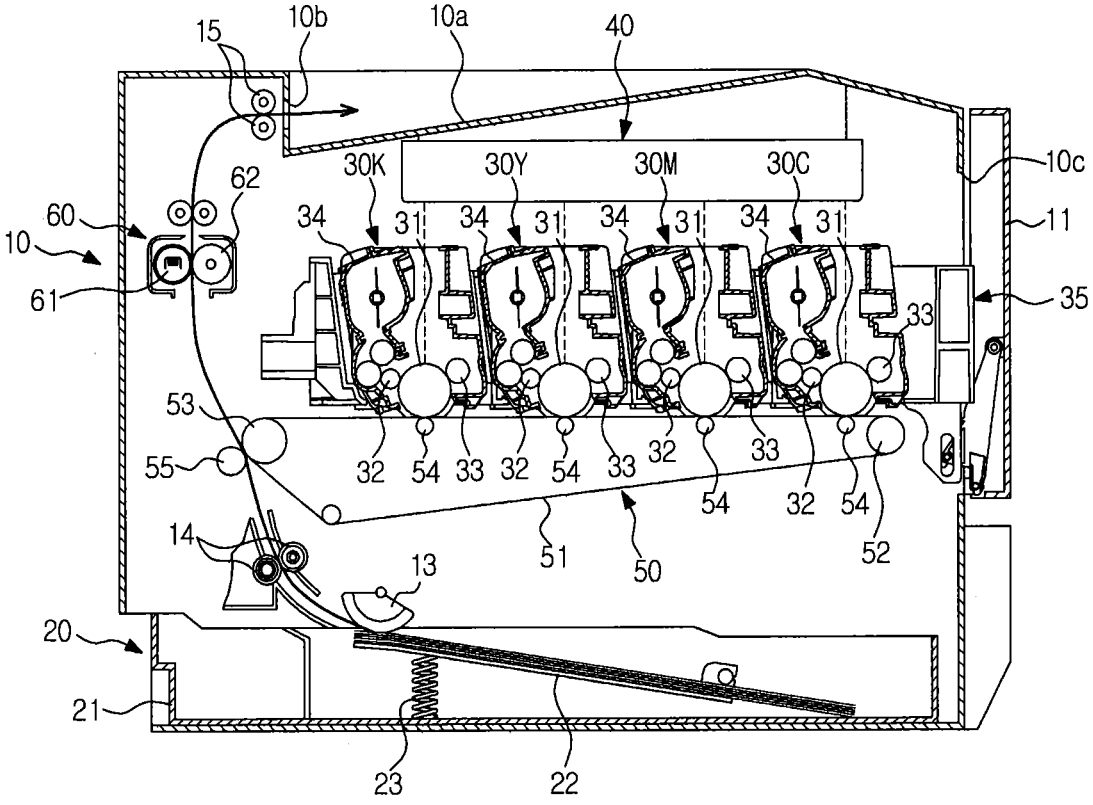
FIG. 1 illustrates an image forming apparatus according to an exemplary embodiment of the present invention.

Reference will now be made in detail to the embodiments of the present invention, examples of which are illustrated in the accompanying drawings, wherein like reference numerals refer to like elements throughout.

As illustrated in FIG. 1, the image forming apparatus according to an exemplary embodiment of the present invention includes a body 10 to define an outer appearance of the apparatus, a printing medium storage unit 20 to store printing mediums therein, a plurality of developing units 30C, 30M, 30Y and 30K configured to develop an electrostatic latent image into a visible image using a corresponding one of developing agents of different colors, an exposure unit 40 to scan light onto photosensitive bodies 31 of the developing units 30C, 30M, 30Y and 30K in a charged state and form an electrostatic latent image on each photosensitive body 31, a transfer unit 50 to receive printing medium from the printing medium storage unit 20 and transfer a visible image formed on each photosensitive body 31 to the printing medium, and a fusing unit 60 to fuse, to the printing medium, the developing agent of the visible image transferred to the printing medium.

The body 10 may be provided, at a top thereof, with a stacking section 10*a*, on which printing mediums having completed image formation are stacked. The stacking section 10*a* may be provided, at a side thereof, with a discharge port 10*b*, through which printing mediums having completed image formation are discharged. The body 10 includes, at a side thereof, an opening 10*c* through which inner components including the developing units 30C, 30M, 30Y and 30K may be detachably mounted. The opening 10*c* may be provided with a cover 11 pivotably installed at the body 10, to open or close the opening 10*c* when rotated.

The printing medium storage unit 20 includes a printing medium cassette 21 movably mounted to the body 10, a knock-up plate 22 disposed in the printing medium cassette 21, to stack printing mediums thereon, and an elastic member 23 to elastically support the knock-up plate 22.

Each of the developing units 30C, 30M, 30Y and 30K includes one photosensitive body 31. On a charged surface of the photosensitive body 31, an electrostatic latent image may be formed by the exposure unit 40. Each of the developing units 30C, 30M, 30Y and 30K includes a developing roller 32 to supply the corresponding developing agent to the photosensitive body 31, a charging roller 33 to charge the surface of the photosensitive body 31, and a developing housing 34 to form an outer appearance of the corresponding developing unit 30C, 30M, 30Y or 30K and to support the photosensitive body 31, the developing roller 32 and the charging roller 33.

Each of the developing units 30C, 30M, 30Y and 30K stores a corresponding one of the developing agents, the color of which may be one of cyan (C), magenta (M), yellow (Y) and black (K). That is, there are, for example, four developing units, namely, developing units 30C, 30M, 30Y and 30K, which may develop different colors, namely, cyan (C), magenta (M), yellow (Y) and black (K), respectively. The four developing units 30C, 30M, 30Y and 30K may be disposed in parallel at an upper side of the transfer unit 50.

The exposure unit 40 irradiates light carrying image information onto the photosensitive bodies 31 provided at respective developing units 30C, 30M, 30Y and 30K to form an electrostatic latent image on the surface of each photosensitive body 31.

The transfer unit 50 includes a transfer belt 51, to which the developing agents used to develop electrostatic latent images on respective photosensitive bodies 31 of the developing units 30C, 30M, 30Y and 30K may be transferred in an overlapping manner, and a drive roller 52 and a driven roller 53, which may be disposed inside the transfer belt 51 at opposite sides of the transfer unit 50, respectively, to rotate the transfer belt 51, a plurality of first transfer rollers 54 disposed to face respective photosensitive bodies 31 of the developing units 30C, 30M, 30Y and 30K with the transfer belt 51 interposed between each first transfer roller 54 and the corresponding photosensitive body 31, to transfer visible images formed on respective photosensitive bodies 31 to the transfer belt 51, and a second transfer roller 55 disposed to face the driven roller 53 with the transfer belt 51 interposed between the second transfer roller 55 and the driven roller 53, to transfer the visible images on the transfer belt 51 to the printing medium fed to the second transfer roller 55.

The fusing unit 60 includes a heating roller 61 to generate heat, and a pressing roller 62 having an outer circumferential surface made of an elastically deformable material, to press the printing medium against an outer circumferential surface of the heating roller 61.

The body 10 includes a pick-up roller 13 disposed over the printing medium storage unit 20, to pick up, for example, one-by-one, the printing mediums stacked on the knock-up plate 22, a feeding roller 14 to upwardly guide the printing medium picked up by the pick-up roller 13, and a discharge roller 15 disposed adjacent to the discharge port 10*b* above the fusing unit 60, to discharge the printing medium emerging from the fusing unit 60 through the discharge port 10*b*.

Figure 2:
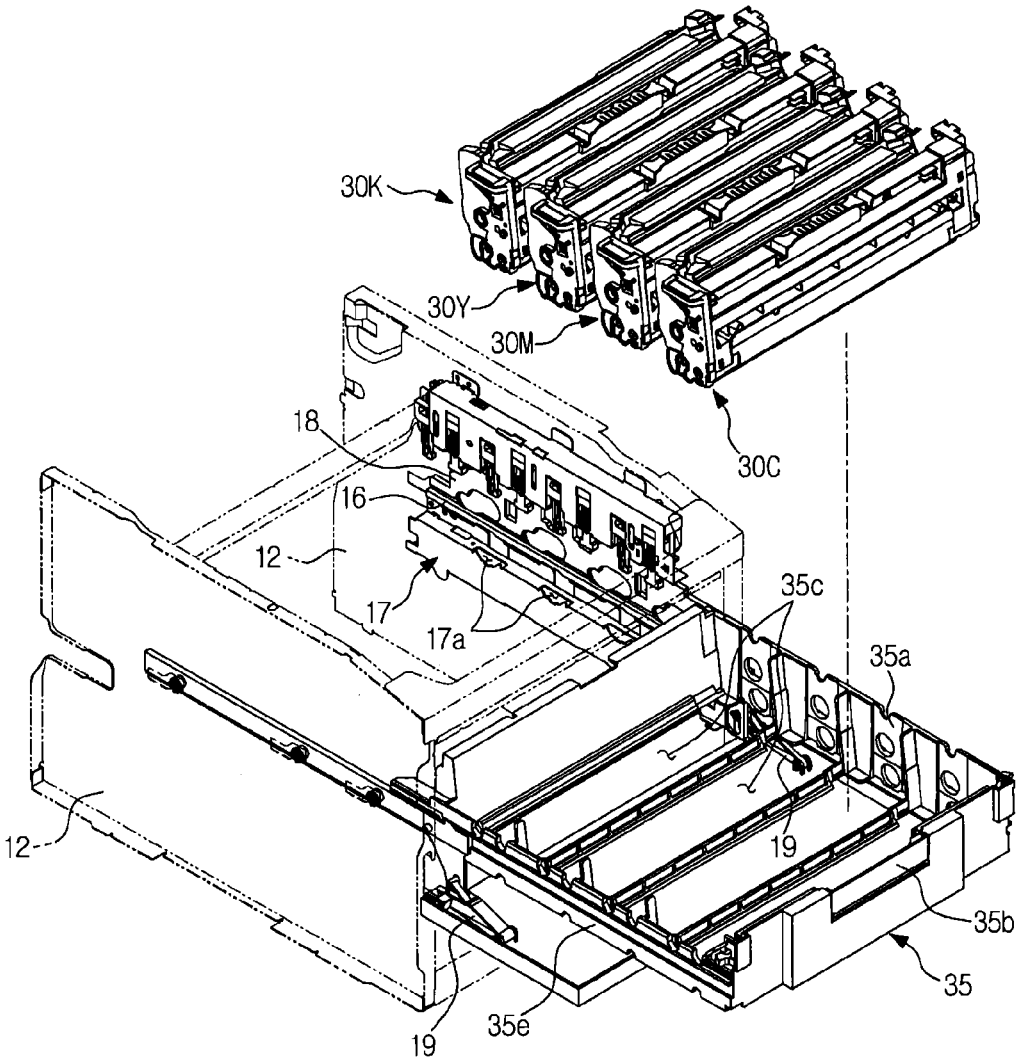
FIG. 2 illustrates developing units and a developing tray to which the developing units are mounted, according to an exemplary embodiment of the present invention.

As illustrated in FIG. 2, the body 10 may be provided with a plurality of, for example, a pair of frames 12 disposed in the body 10, to form opposite inner sides of the body 10 and support the inner components of the image forming apparatus. The frames 12 may be made of a metallic material having sufficient strength to support the inner components of the image forming apparatus.

Developing units 30C, 30M, 30Y and 30K, which contain the developing agents, may be replaced after the developing agents are completely consumed.

Accordingly, a developing tray 35 may be movably installed at the opening 10*c*, for installation of the developing units 30C, 30M, 30Y and 30K. The developing units 30C, 30Mf, 30Y and 30K may be mounted to the developing tray 35 in turn such that when the developing tray 35 moves into the body 10 through the opening 10*c*, the developing units 30C, 30M, 30Y and 30K are mounted in the body 10, and when the developing tray 35 moves outside the body 10 through the opening 10*c*, the developing units 30C, 30M, 30Y and 30K are extracted from the body 10. The developing units 30C, 30M, 30Y and 30K may be arranged from the front side of the body 10 to the rear side thereof at the developing tray 35, and the developing tray 35 may be movable forward or backward to enter or come out of the body 10.

The developing tray 35 includes a tray section 35*a*, to which the developing units 30C, 30M, 30Y and 30K are mounted, and a handle 35*b* provided at one end of the tray section 35*a*, to allow a user to easily apply force to the developing tray 35. Alternately provided on a lower surface of the tray section 35*a* are through holes 35*c* to allow the photosensitive bodies 31 respectively provided at the developing units 30C, 30M, 30Y and 30K to protrude downward from the tray section 35*a* to contact the transfer belt 51 disposed under the tray section 35*a*, and supports 35*d* to support the lower ends of the developing units 30C, 30M, 30Y and 30K such that the developing units 30C, 30M, 30Y and 30K may remain installed at the tray section 35*a*.

First guide rails 16 at which the developing tray 35 may be movably installed are respectively installed at inner sides of the frames 12 such that the developing tray 35 is movably installed in the body 10, and second guide rails 35*e* movably installed at the first guide rails 16 may be respectively installed on the opposite sides of the tray section 35*a* of the developing tray 35.

Figure 3:
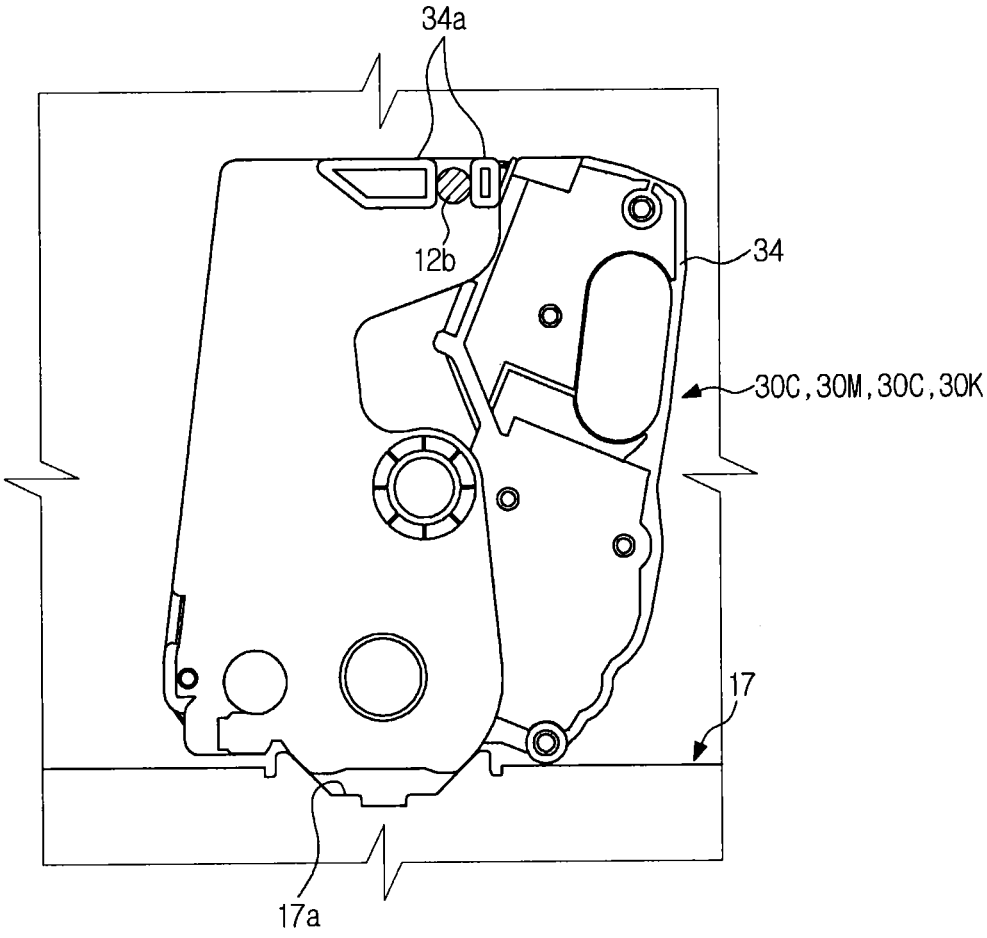
FIG. 3 illustrates developing units mounted in a body of an image forming apparatus according to an exemplary embodiment of the present invention.

Provided in the body 10 are seats 17*a* to regulate positions of the developing units 30C, 30M, 30Y and 30K mounted to the developing tray 35. According to an exemplary embodiment, a plurality of seating grooves 17*a* are arranged in parallel on top of each seating member 17 installed at the corresponding frame 12. Accordingly, the lower ends of the developing units 30C, 30M, 30Y and 30K are respectively seated at, and supported by, the seating grooves 17*a*. As illustrated in FIG. 3, the seating grooves 17*a* of the present embodiment are formed to be open upward and have a V-shaped cross section.

When the lower ends of the developing units 30C, 30M, 30Y and 30K are seated at and supported by the seating grooves 17*a* of the seating members 17 fixed to the frames 12 as above, relative positions of the photosensitive bodies 31 with respect to other components supported by the frames 12, especially the transfer belt 51 facing the photosensitive bodies 31 or the first transfer rollers, may be precisely regulated, and thereby a uniform image quality may be obtained.

With the developing units 30C, 30M, 30Y and 30K seated at the seating grooves 17*a*, the developing units 30C, 30M, 30Y and 30K may be inclined with respect to lower ends thereof. Thus, to prevent the inclination of the developing units 30C, 30M, 30Y and 30K, each of the developing units 30C, 30M, 30Y and 30K is provided with a plurality of, for example, a pair of protruding portions 34*a* disposed on one side of the developing housing 34 to be spaced from each other, and a corresponding projection 12*b* is disposed at the frame 12 to be stuck between the two protruding portions 34*a* to prevent rotation of the developing housing 34 with each of the developing units 30C, 30M, 30Y and 30K seated at the corresponding seating groove 17*a*.

In order for the lower ends of the developing units 30C, 30M, 30Y and 30K to be seated at the seating grooves 17*a*, the developing units 30C, 30M, 30Y and 30K may be vertically moved. According to an exemplary embodiment, the developing tray 35 equipped with the developing units 30C, 30M, 30Y and 30K moves upward and downward in connection with the opening and closing operation of the cover 11 to move the developing units 30C, 30M, 30Y and 30K upward and downward. That is, when the opening 10*c* is opened by the cover 11, the developing tray 35 moves upward and thus the lower ends of the developing units 30C, 30M, 30Y and 30K installed at the developing tray 35 are detached from the seating grooves 17*a*. When the opening 10*c* is closed by the cover 11, the developing tray 35 moves downward and thus the lower ends of the developing units 30C, 30M, 30Y and 30K installed at the developing tray 35 are seated at the seating grooves 17*a*.

Figure 4:
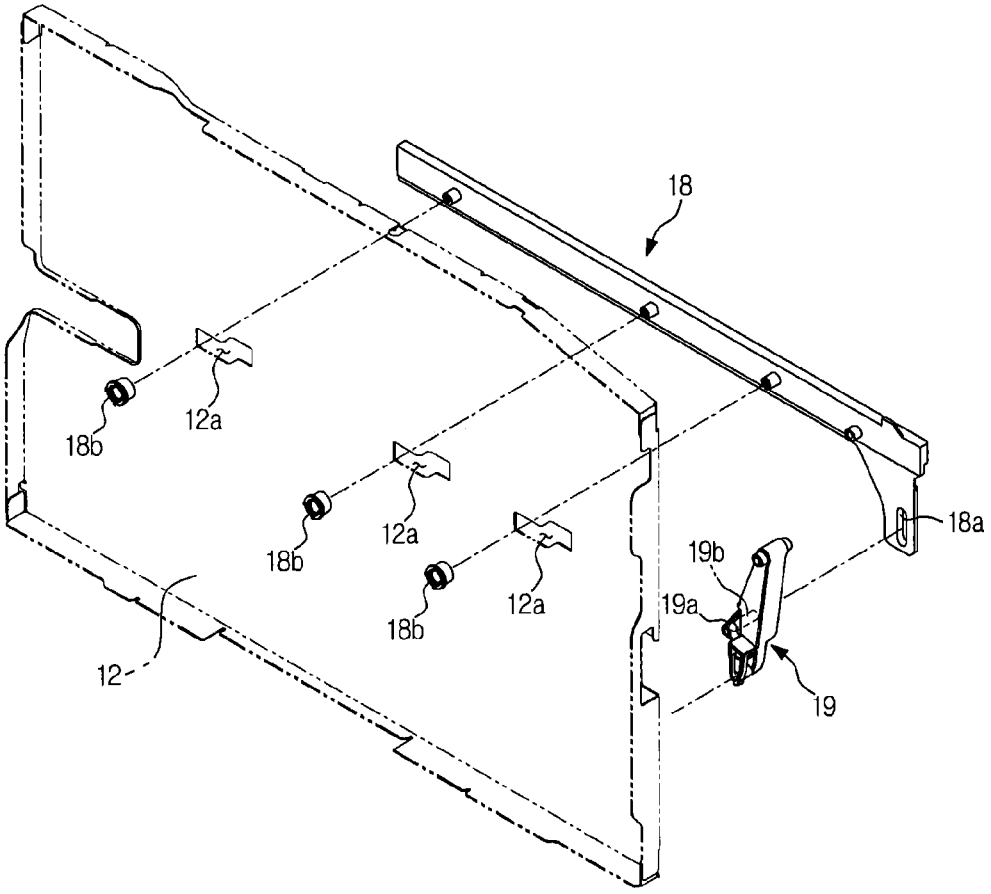
FIGS. 4 and 5 illustrate a movement guide installed at a frame and a pressing unit, in accordance with an exemplary embodiment of the present invention.
Figure 5:
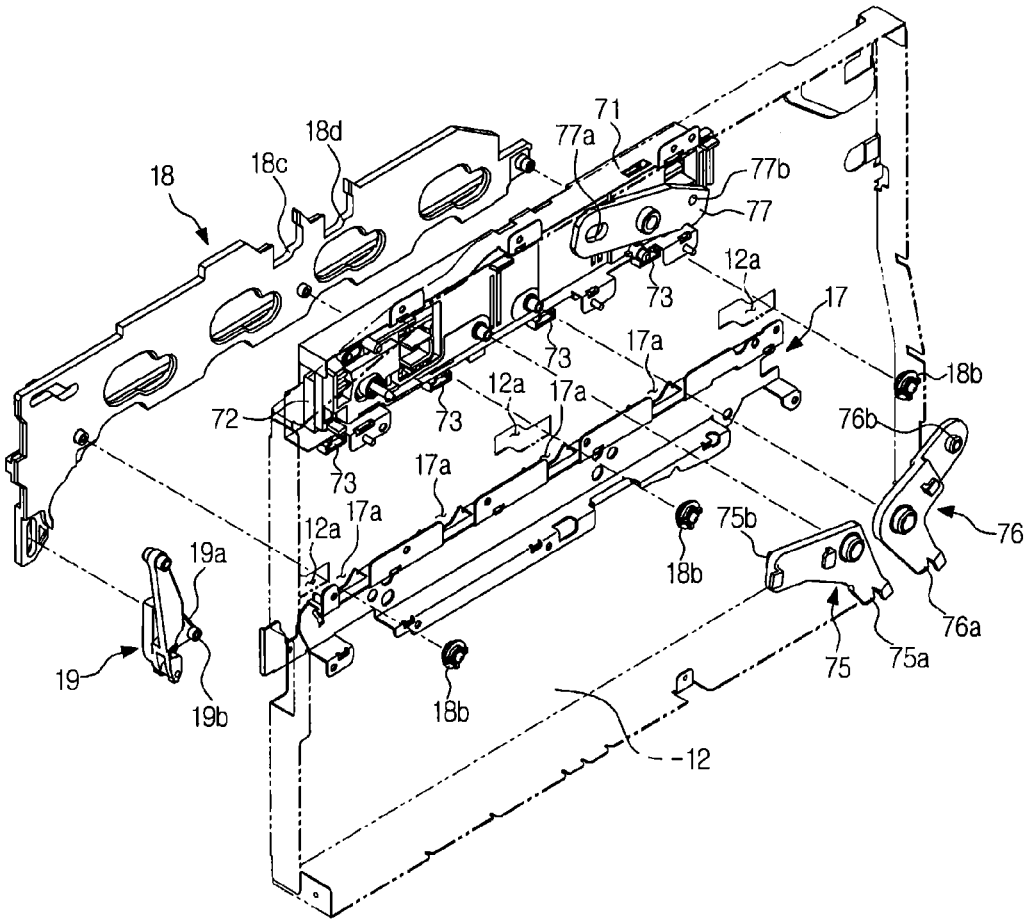

To allow the developing tray 35 to be vertically movable in connection with the cover 11 as above, a movement guide 18 may be installed at the inner side of each frame 12, as illustrated in FIGS. 4 and 5. The movement guides 18 may be installed at the inner sides of the frames 12 to be vertically movable, and the first guide rail 16 may be installed at the inner side of the movement guide 18. The developing tray 35 are allowed to move horizontally though the first guide rails 16 and the second guide rails 35*e*, are allowed to move vertically together with the movement guide 18 according to vertical movement of the movement guide 18.

To make the movement guide 18 operate in connection with the cover 11, an engagement link 19 may be installed between the cover 11 and the movement guide 18. Two engagement links 19 may be provided to correspond to the two movement guides 18. One end of each engagement link 19 is installed at one side of the inner surface of the cover 11, and the other end of each engagement link 19 may be pivotably installed at a corresponding one of the two frames 12 of the body 10 such that the cover 11 may be pivotably installed at the body 10*a*. An engagement portion 19*a* protruding toward the corresponding movement guide 18 is provided in the middle of each engagement link 19, and an engagement projection 19*b* installed at the corresponding movement guide 18 to be vertically movable is formed at the engagement portion 19*a*. An engagement slot 18*a*, at which the engagement projection 19*b* is installed to be vertically movable, may be provided at one end of the corresponding movement guide 18 proximate to the cover 11 with the longitudinal direction of the engagement slot 18*a* arranged vertically. Accordingly, the movement guides 18 move horizontally within a specific interval according to the opening and closing operation of the cover 11.

To allow the movement guides 18 to move vertically as they move horizontally, each of the two frames 12 may be provided with a plurality of guide slots 12*a* and guide members 18*b* are installed at each movement guide 18 such that they are respectively fixed at positions corresponding to the guide slots 12*a* and disposed in the guide slots 12*a*.

Figure 6:
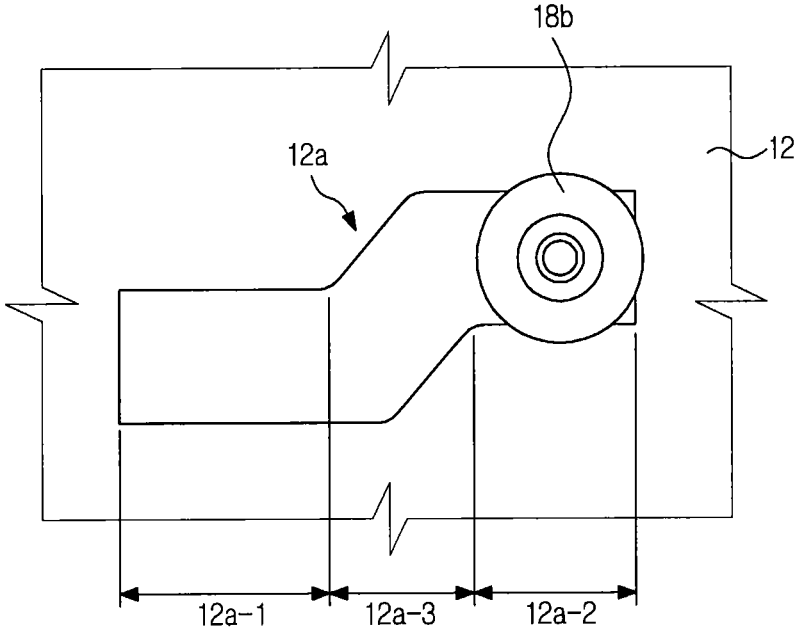
FIG. 6 illustrates a guide slot provided at a frame in accordance with an exemplary embodiment of the present invention.

As illustrated in FIG. 6, each of the guide slots 12*a* includes a first guide section 12*a*-1, which extends horizontally and guides downward movement of the movement guides 18, a second guide section 12*a*-2, which extends horizontally and is formed at a higher position than the first guide section 12*a*-1 to guide upward movement of the movement guides 18, and an inclined section 12*a*-3, which extends to connect the first guide section 12*a*-1 and the second guide section 12*a*-2.

As illustrated in FIG. 5, the image forming apparatus includes a pressing unit 70 to press the developing units 30C, 30M, 30Y and 30K downward to ensure that the lower ends of the developing units 30C, 30M, 30Y and 30K remain stably seated at the seating grooves 17*a*.

The pressing unit 70, which is configured to operate in connection with movement of one of the two movement guides 18, includes a pressing housing 71 forming an outer appearance of the pressing unit 70 and fixed to one of the frames 12, a pressing frame 72 installed in the pressing housing 71 to be vertically movable such that the pressing frame 72 moves up or down according to opening or closing of the cover 11 and movement of the movement guide 18, a plurality of pressing members 73 installed at the pressing housing 71 to be vertically movable and having lower ends pressing the developing units 30C, 30M, 30Y and 30K downward, a plurality of elastic members 74 to elastically support the respective support members 73 downward, and a plurality of raising and lowering links 75, 76 and 77 to rotate according to movement of the movement guide 18 to raise or lower the pressing frame 72.

The plurality of raising and lowering links 75, 76 and 77 includes a first raising and lowering link 75 to transfer force to one end of the pressing frame 72, and a second raising and lowering link 76 and a third raising and lowering link 77 to transfer force to the other end of the pressing frame 72.

The first raising and lowering link 75, which may be formed to have a V shape and has a middle portion rotationally installed at the pressing housing 71, includes a first cam portion 75*a* supported by an upper end of the corresponding movement guide 18, and a first hinge portion pivotably installed at one end of the pressing frame 72. The second raising and lowering link 76, which may be formed to have a V shape and has a middle portion rotationally installed at the pressing housing 71, includes a second cam 76*a* supported by the upper end of the corresponding movement guide 18, and a first connecting portion 76*b* to which the third raising and lowering link 77 is pivotably connected. The third raising and lowering link 77, which is formed to have a shape of a bar and has a middle portion rotationally installed at the pressing housing 71, includes a second connecting portion 77*a* pivotably connected to the first connecting portion 76*b*, and a second hinge 77*b* pivotably installed at the other end of the pressing frame 72.

The movement guide 18 is provided, on an upper end thereof, a first cam surface 18*c* to interact with the first cam portion 75*a*, and a second cam surface 18*d* to interact with the second cam portion 76*a*.

An exemplary operation of an image forming apparatus is disclosed.

Figure 7:
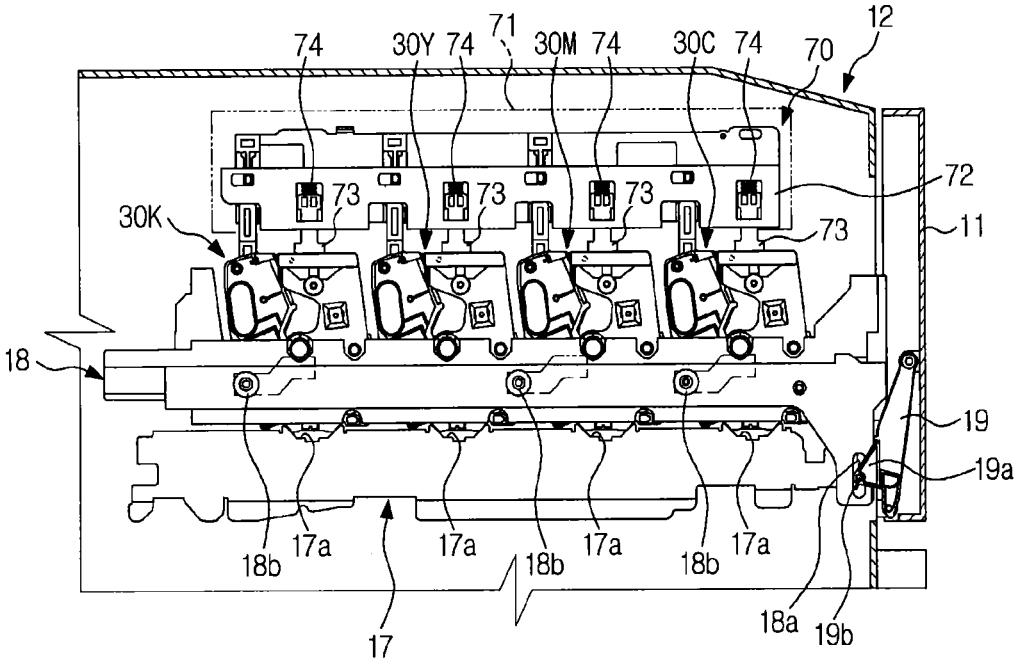
FIGS. 7 and 8 illustrate exemplary operations of the movement guide and the developing unit operating in connection with a cover, in accordance with an exemplary embodiment of the present invention.
Figure 8:
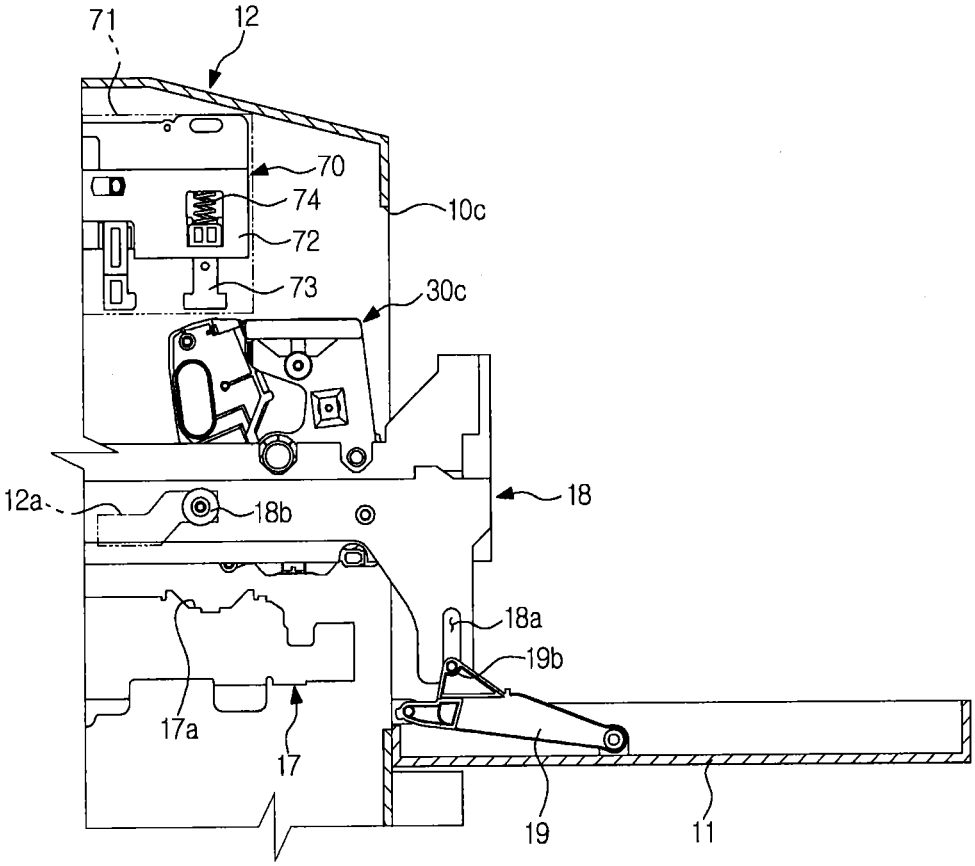

If the user applies force to the cover 11 to open the opening 10*c* when the opening 10*c* is closed by the cover 11 as illustrated in FIG. 7, the movement guide 18 receives the force transferred from the cover 11 through the engagement projection 19*b* and the engagement slot 18*a* and moves toward the opening 10*c* as the opening 10*c* is opened, as illustrated in FIG. 8. Thereby, the movement guide 18 moves upward as the guide member 18*b* moves from the first guide section 12*a*-1 to the second guide section 12*a*-2 through the inclined section 12*a*-3. The developing tray 35 and the developing units 30C, 30M, 30Y and 30K mounted to the developing tray 35 move upward, and the lower ends of the developing units 30C, 30M, 30Y and 30K are detached from the seating grooves 17*a*.

Figure 9:
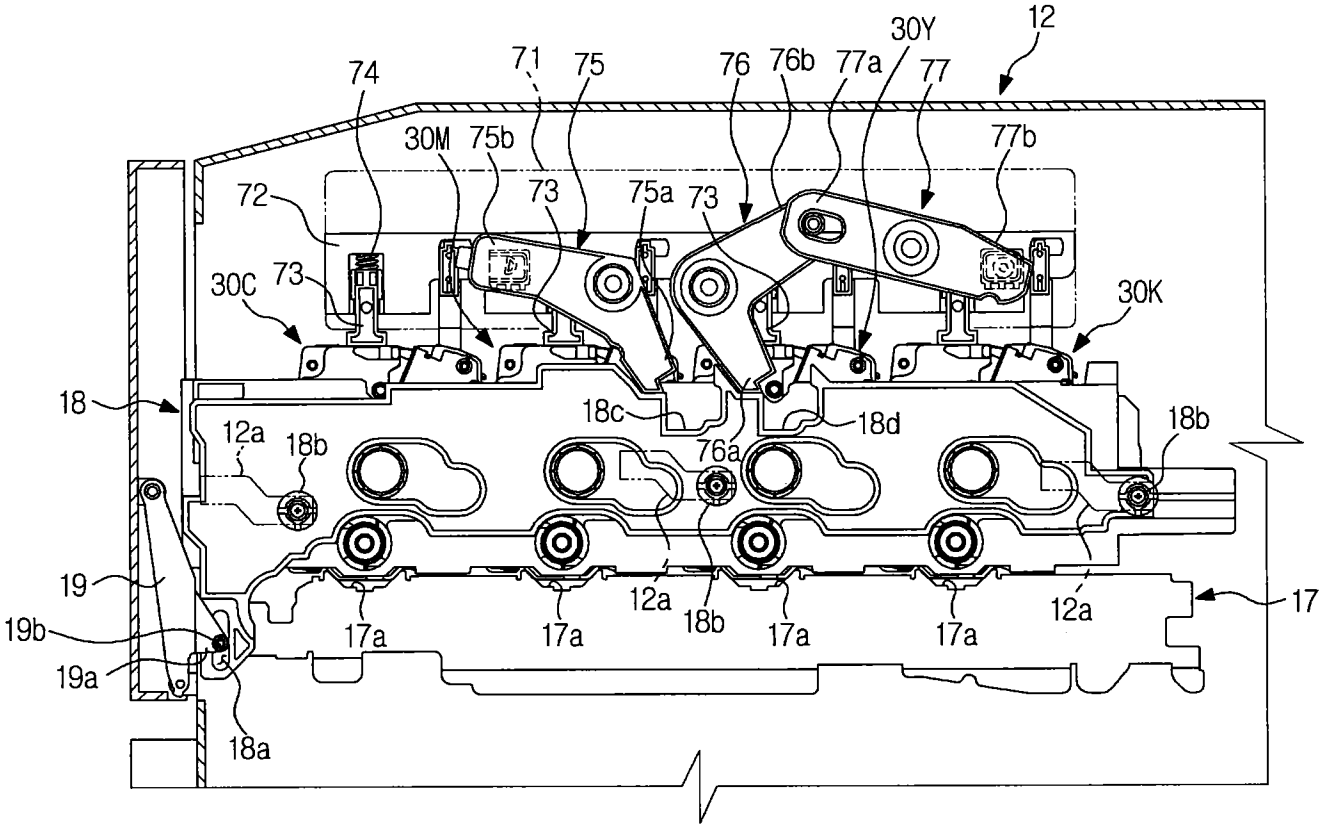
FIGS. 9 and 10 illustrate an exemplary operation of the pressing unit operating in connection with the cover, in accordance with an exemplary embodiment of the present invention.

As illustrated in FIG. 9, the first raising and lowering link 75 and the second raising and lowering link 76 supported by the first cam surface 18*c* and the second cam surface 18*d* of the movement guide 18 through the first cam portion 75*a* and the second cam portion 76*a* rotate in one direction according to movement of the movement guide 18. Thereby, as illustrated in FIG. 10, the pressing frame 72 moves upward, and the lower ends of the pressing members 73 installed at the pressing frame 72 are separated from the upper surfaces of the developing units 30C, 30M, 30Y and 30K.

If the user applies force to the cover 11 to close the opening 10*c* when the opening 10*c* is opened by the cover 11 as illustrated in FIG. 8, the movement guide 18 receives force transferred from the cover 11 through the engagement projection 19*b* and the engagement slot 18*a* and moves into the body 10 as the opening 10*c* is closed, as illustrated in FIG. 7. Thereby, the movement guide 18 moves downward as the guide member 18*b* moves from the second guide section 12*a*-2 to the first guide section 12*a*-1 through the inclined section 12*a*-3. The developing tray 35 and the developing units 30C, 30M, 30Y and 30K mounted to the developing tray 35 move downward, and the lower ends of the developing units 30C, 30M, 30Y and 30K are seated at the seating grooves 17*a*.

Figure 10:
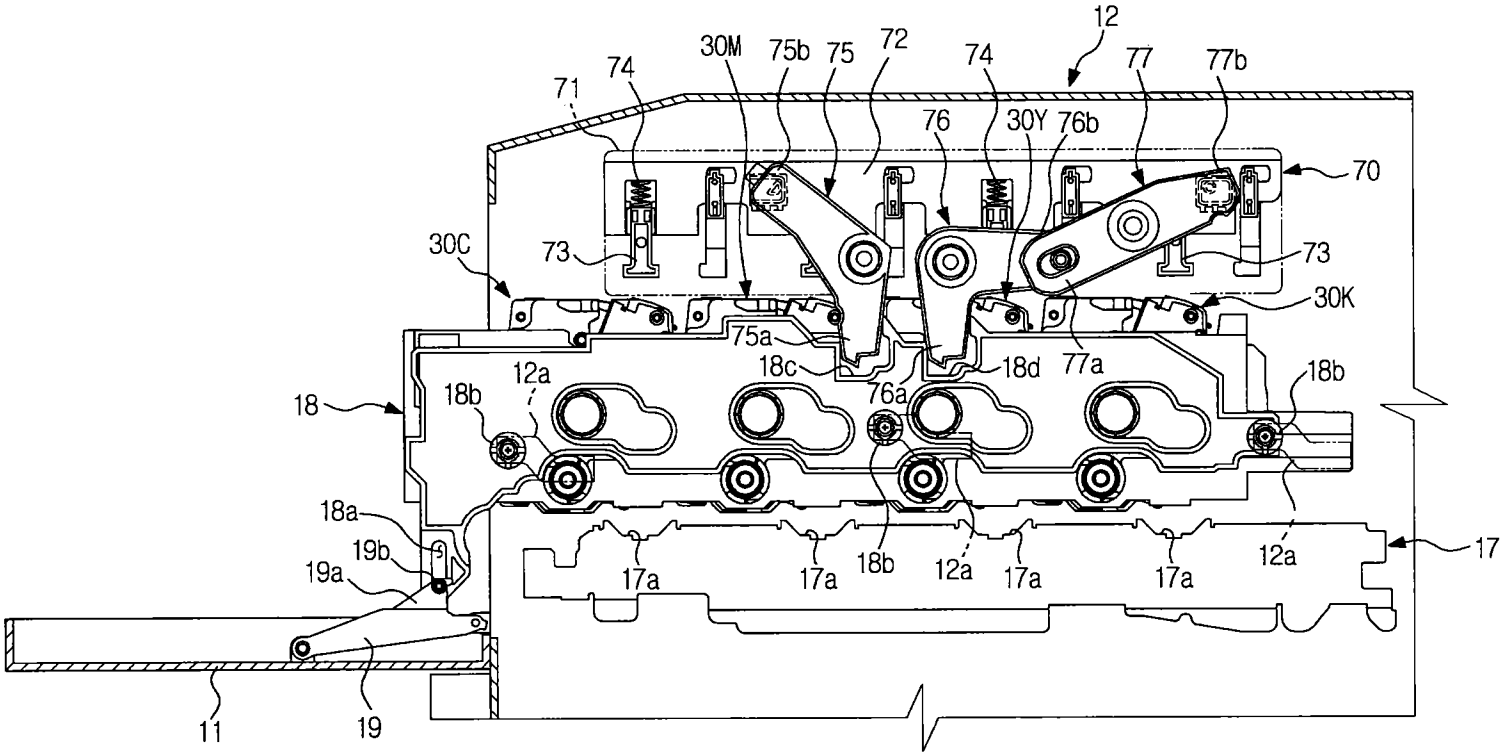

As illustrated in FIG. 10, the first raising and lowering link 75 and the second raising and lowering link 76 supported by the first cam portion surface 18*c* and the second cam surface 18*d* of the movement guide 18 through the first cam portion 75*a* and the second cam portion 76*a* rotate in the opposite direction according to movement of the movement guide 18. Thereby, as illustrated in FIG. 9, the pressing frame 72 moves downward, and the lower ends of the pressing members 73 installed at the pressing frame 72 contact the upper surfaces of the developing units 30C, 30M, 30Y and 30K to press the developing units 30C, 30M, 30Y and 30K downward.

According to an exemplary embodiment, the seating grooves 17*a* may be arranged at the seating member 17 and may be manufactured separately from the frame 12 and mounted to the frame 12, but the embodiments of the present invention are not limited thereto. The form of the frame 12 may be changed to integrate the seating member 17 into the frame 12. According to an exemplary embodiment, the projection 12*b* may be arranged at the frame 12, while the protruding portions 34*a* may be arranged at the developing housing, but the embodiments of the present invention are not limited thereto. The projection may be arranged at the developing housing and the protruding portions arranged at the frame.

The developing units may be supported by being seated at seating grooves provided at the frames in the body, and therefore the positions of the photosensitive bodies of the developing units with respect to other constituents supported by the frames may be accurately regulated, and thereby a uniform image quality may be obtained.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An image forming apparatus comprising:

a body provided with an opening at a side thereof;

a developing tray movably installed at the opening;

a plurality of developing units mounted to the developing tray;

a pair of frames forming opposite inner sides of the body;

a plurality of seating grooves provided in the frames to support lower ends of the plurality of developing units;

a pair of movement guides allowing the developing tray to be installed thereon to be horizontally movable, and installed respectively at the pair of frames to be vertically movable;

a plurality of guide members installed at the movement guides to allow the movement guides to be movably installed at the frames, each of the frames includes a plurality of guide slots in which the guide members are movably installed; and a cover installed at the body to open and close the opening, wherein upon the opening being opened by the cover, a lower end of at least one of the plurality of developing units is detached from the corresponding one of the plurality of seating grooves.

2. The image forming apparatus according to claim 1, further comprising a plurality of seating members, each of which is provided with a plurality of seating grooves on an upper side thereof and disposed at a corresponding one of the pair of the frames.

3. The image forming apparatus according to claim 2, wherein each of the seating members is integrated into the corresponding one of the frames.

4. The image forming apparatus according to claim 1, wherein each of the seating grooves is open upward and formed to have a V shape.

5. The image forming apparatus according to claim 2, wherein each of the developing units includes an outer developing housing, wherein:

the outer developing housing includes a pair of protruding portions disposed at an upper portion of one side of the developing housing and spaced from each other; and a corresponding one of the frames includes a projection which is supported between the pair of protruding portions.

6. The image forming apparatus according to claim 2, further comprising:

the cover pivotably installed at the body to rotate about a lower end of the cover to open and close the opening;

a plurality of engagement links to move the movement guides according to opening and closing of the cover.

7. The image forming apparatus according to claim 6, wherein each of the guide slots includes a first guide section to guide downward movement of a corresponding one of the movement guides, a second guide section formed at a higher position than the first section to guide upward movement of the corresponding one of the movement guides, and an inclined section formed to be inclined to connect the first guide section and the second guide section.

8. The image forming apparatus according to claim 6, wherein each of the engagement links includes an engagement portion protruding toward a corresponding one of the movement guides, and an engagement projection arranged at the engagement portion, wherein the corresponding one of the movement guides includes an engagement slot extending vertically to allow the engagement projection to be installed therein to be vertically movable.

9. The image forming apparatus according to claim 7, further comprising a pressing unit to press the developing units downward in connection with movement of the movement guides.

10. The image forming apparatus according to claim 9, wherein the pressing unit includes a pressing housing forming an outer appearance of the pressing unit and installed at one of the frames, a pressing frame installed in the pressing housing to be vertically movable, at least one pressing member installed at the pressing frame to be vertically movable, and at least one elastic member to elastically support the at least one pressing member downward.

11. An image forming apparatus comprising:

a body provided with an opening at a side thereof;

a developing tray movably installed at the opening;

a plurality of developing units mounted to the developing tray;

a pair of frames forming opposite inner sides of the body;

a plurality of seating grooves provided in the frames to support lower ends of the plurality of developing units;

a plurality of seating members, each of which is provided with a plurality of seating grooves on an upper side thereof and disposed at a corresponding one of the pair of the frames, a cover pivotably installed at the body to rotate about a lower end of the cover to open and close the opening;

a pair of movement guides allowing the developing tray to be installed thereon to be horizontally movable, and installed respectively at the pair of frames to be vertically movable;

a plurality of engagement links to move the movement guides according to opening and closing of the cover;

a plurality of guide members installed at the movement guides to allow the movement guides to be movably installed at the frames; and a pressing unit to press the developing units downward in connection with movement of the movement guides, wherein each of the frames includes a plurality of guide slots in which the guide members are movably installed, wherein each of the guide slots includes a first guide section to guide downward movement of a corresponding one of the movement guides, a second guide section formed at a higher position than the first section to guide upward movement of the corresponding one of the movement guides, and an inclined section formed to be inclined to connect the first guide section and the second guide section, wherein the pressing unit includes a pressing housing forming an outer appearance of the pressing unit and installed at one of the frames, a pressing frame installed in the pressing housing to be vertically movable, at least one pressing member installed at the pressing frame to be vertically movable, and at least one elastic member to elastically support the at least one pressing member downward, wherein the pressing unit further includes a plurality of raising and lowering links rotatably installed at the pressing housing such that the pressing frame is raised or lowered in connection with movement of the movement guides as the plurality of raising and lowering links rotates.

12. The image forming apparatus according to claim 11, wherein the plurality of raising and lowering links includes a first raising and lowering link to transfer force to one end of the pressing frame, and a second raising and lowering link and a third raising and lowering link to transfer the force to the other end of the pressing frame, wherein:

the first raising and lowering link includes a first cam portion supported by a corresponding one of the movement guides, and a first hinge portion pivotably installed at one end of the pressing frame;

the second raising and lowering link includes a second cam supported by the corresponding one of the movement guides, and a first connecting portion connected with the third raising and lowering link;

the third raising and lowering link includes a second connecting portion pivotably connected to the first connecting portion, and a second hinge pivotably installed at the other end of the pressing frame; and the corresponding one of the movement guides includes a first cam surface to interact with the first cam portion, and a second cam surface to interact with the second cam portion.

13. An image forming apparatus comprising:

a body provided with an opening at a side thereof;

a developing tray movably installed at the opening;

a plurality of developing units mounted to the developing tray;

a pair of frames forming opposite inner sides of the body;

a pair of movement guides allowing the developing tray to be installed thereon to be horizontally movable, and installed respectively at the pair of the frames to be vertically movable;

a plurality of guide members installed at the movement guides to allow the movement guides to be movably installed at the frames, each of the frames includes a plurality of guide slots in which the guide members are movably installed;

a cover pivotably installed at the body to rotate about a lower end of the cover to open and close the opening; and a pressing unit to press the developing units downward in connection with a closing of the cover, wherein upon the opening being opened by the cover, a lower end of at least one of the plurality of developing units is detached from a seating groove.

14. The image forming apparatus according to claim 13, further comprising:

an engagement link configured to move the movement guides according to opening and closing of the cover.

15. The image forming apparatus according to claim 14, wherein the pressing unit includes an outer pressing housing and installed at one of the frames, a pressing frame installed in the outer pressing housing to be vertically movable, at least one pressing member installed at the pressing frame to be vertically movable, and at least one elastic member to elastically support the at least one pressing member downward.

16. An image forming apparatus comprising;

a body provided with an opening at a side thereof;

a developing tray movably installed at the opening;

a plurality of developing units mounted to the developing tray;

a pair of frames forming opposite inner sides of the body;

a cover pivotably installed at the body to rotate about a lower end of the cover to open and close the opening;

a pressing unit to press the developing units downward in connection with a closing of the cover, a pair of movement guides allowing the developing tray to be installed thereon to be horizontally movable, and installed respectively at the pair of the frames to be vertically movable;

an engagement link configured to move the movement guides according to opening and closing of the cover; and a plurality of guide members installed at the movement guides to allow the movement guides to be movably installed at the frames, wherein each of the frames includes a plurality of guide slots in which the guide members are movably installed, wherein the pressing unit includes an outer pressing housing and installed at one of the frames, a pressing frame installed in the outer pressing housing to be vertically movable, at least one pressing member installed at the pressing frame to be vertically movable, and at least one elastic member to elastically support the at least one pressing member downward, wherein the pressing unit further includes a plurality of raising and lowering links rotatably installed at the pressing housing such that the pressing frame is raised or lowered in connection with movement of the movement guides as the plurality of raising and lowering links rotates.

17. An image forming apparatus comprising:

a body provided with an opening;

a frame disposed in the body;

a developing tray movably installed at the frame to enter and come out of the body through the opening;

a plurality of developing units configured to contain developing agents and detachably mounted to the developing tray, each of the developing units including a developing housing having one side facing the frame;

a plurality of projections protruding from one of the one side of the developing housing and the frame to respectively correspond to the developing units; and a plurality of protruding portions provided at the other one of the one side of the developing housing and the frame to respectively correspond to the projections, each of the protruding portions restricting a corresponding one of the projections to limit movement of a corresponding one of the developing units, wherein upon the opening being opened by a cover, a lower end of at least one of the plurality of developing units is detached from a seating groove; and wherein the plurality of projections are fixed and interposed respectively between the plurality of protruding portions.

18. The image forming apparatus according to claim 17, wherein the plurality of the protruding portions includes a pair of protruding portions configured to correspond to one of the projections and disposed to be spaced from each other, wherein the corresponding one of the projections is supported between the pair of the protruding portions.

19. The image forming apparatus according to claim 18, wherein:

the plurality of the developing units is arranged from the front side of the body to the rear side thereof; and the pair of the protruding portions is disposed to support front and rear sides of the corresponding one of the projections.

20. The image forming apparatus according to claim 17, wherein the plurality of the projections is disposed at the frame, and each of the plurality of the protruding portions is disposed at the developing housing of a corresponding one of the developing units.

21. The image forming apparatus according to claim 17, wherein:

each of the developing units further includes a photosensitive body rotatably supported by a lower end thereof; and each of the plurality of the protruding portions is disposed to limit movement of an upper end of a corresponding one of the developing units.

22. The image forming apparatus according to claim 17, further comprising a plurality of seating grooves provided at the frame to respectively support lower ends of the plurality of developing units.

23. A developing unit mountable to a body of an image forming apparatus through a developing tray movably installed to at least one frame, comprising:

a developing housing having a side facing the frame when the developing unit is mounted to the image forming apparatus; and a plurality of protruding portions provided at the side of the developing housing such that when the developing unit is mounted to the image forming apparatus, wherein the plurality of protruding portions are coupled with a projection provided at the frame to limit movement of the developing unit, wherein upon an opening being opened by a cover, a lower end of at least one of a plurality of developing units is detached from a seating groove, wherein the projection is fixed and interposed between the plurality of protruding portions.

24. The developing unit according to claim 23, further comprising a photosensitive body rotatably installed at a lower end of the developing housing, wherein the plurality of protruding portions are disposed at an upper end of the developing housing.

25. The developing unit according to claim 23, wherein the plurality of protruding portions includes a pair of protruding portions disposed to be spaced from each other to support opposite sides of the projection provided at the frame.

26. The developing unit according to claim 23, wherein:

the plurality of protruding portions are arranged at an upper end of the side of the developing housing to limit movement of an upper end of the developing housing; and a lower end of the developing housing is supported by a seating groove provided at the frame when the developing housing is mounted to the image forming apparatus.

* * * * *